US007280958B2

(12) United States Patent
Pavlov et al.

(10) Patent No.: US 7,280,958 B2
(45) Date of Patent: Oct. 9, 2007

(54) METHOD AND SYSTEM FOR SUPPRESSING RECEIVER AUDIO REGENERATION

(75) Inventors: Peter M. Pavlov, Plantation, FL (US); Jason D. McIntosh, Weston, FL (US); Graeme P. Johnson, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 190 days.

(21) Appl. No.: 11/241,351

(22) Filed: Sep. 30, 2005

(65) Prior Publication Data

US 2007/0078647 A1 Apr. 5, 2007

(51) Int. Cl.
*G10L 11/04* (2006.01)
*G10L 21/00* (2006.01)

(52) U.S. Cl. ..... 704/207; 704/205; 704/270; 455/151.2; 381/93

(58) Field of Classification Search ..... 704/205, 704/207
See application file for complete search history.

(56) References Cited

U.S. PATENT DOCUMENTS 3,624,298 A * 11/1971 Davis et al. ..... 381/66
5,245,665 A * 9/1993 Lewis et al. ..... 381/93
5,644,677 A * 7/1997 Park et al. ..... 704/207
5,999,631 A * 12/1999 Porayath et al. ..... 381/93
2004/0151332 A1* 8/2004 Danielsen et al. ..... 381/318
2005/0190929 A1* 9/2005 Sporer et al. ..... 381/93
2006/0177799 A9* 8/2006 Stuart et al. ..... 434/112

FOREIGN PATENT DOCUMENTS

EP 404117 A * 12/1990

OTHER PUBLICATIONS

Schroeder, M.R. "Improvement of Acoustic-Feedback Stability by Frequency Shifting," The Journal of the Acoustical Society of America, vol. 36, No. 9, Sep. 1964.*

* cited by examiner

*Primary Examiner*—David Hudspeth
*Assistant Examiner*—Eunice Ng

(57) ABSTRACT

The invention concerns a method (500) and system (100) for suppressing receiver audio regeneration. The method (500) includes the steps of receiving a communication signal (502), at a Radio Frequency (RF) unit (102), demodulating the communication signal to an audio signal (504), monitoring a volume level of the audio signal (506), and shifting the pitch of the audio signal when the volume level reaches a predetermined threshold (508), and playing the pitch-shifted audio signal out of a speaker to produce a pitch-shifted acoustic signal (510). The method can shift the pitch of the audio signal to produce a pitch-shifted acoustic signal with signal properties suppressing regeneration of the acoustic signal onto the audio signal at the RF unit. The amount of pitch-shifting can be a function of the volume level.

20 Claims, 7 Drawing Sheets

METHOD AND SYSTEM FOR SUPPRESSING RECEIVER AUDIO REGENERATION

FIELD OF INVENTION

This invention relates in general to methods and systems that transmit and receive audio and more particularly, to high audio speaker phone systems.

BACKGROUND

In recent years, portable electronic devices, such as cellular telephones and personal digital assistants, have become commonplace. Many of these devices include a Radio Frequency (RF) modulator section. The RF modulator can reside within a transmitter unit on a portable device to modulate base-band signals to communication signal frequencies for transmission whereby the communication signals are broadcast to other portable units with a RF modulator at the receiver unit capable of demodulating the signals back down to base-band. The base-band signals can be decoded into an audio signal and broadcast through a speaker to a user of the receiving portable electronic device.

Many of the portable handset devices include a high-audio speaker to play the audio signal at higher volume levels. A power amplifier is generally coupled to the speaker to amplify the signal sufficiently such that the user can adequately hear the output audio. The high audio speaker is generally a transducer which converts electrical signals to mechanical movements through the electro-magnetic coupling of a permanent magnet and voice coil attached to a diaphragm. The movement of the diaphragm moves air and thereby creates pressure differences which produce an acoustic signal.

The speaker needs to move a large amount of air to produce a high volume audio signal where the pressure level is proportional to acceleration of the air. Accordingly, a large amount of force is required to move the air at the diaphragm where the amount of force is a function of the size of the diaphragm and the size of the magnet. The forceful movement of the diaphragm at high audio levels can also push air into and out of the handset creating pressure which accordingly produces vibrations in the handset device. Also, when the handset is not properly enclosed or sealed, the internal acoustic pressure can leak to other compartments within the handset. The problem is exacerbated when the speaker is in close proximity to the electrical board components. All devices and components internal to the handset can be subject to these vibrations. These vibrations can induce bending of component boards such as those that house the RF modulation circuitry.

The electro-mechanical-acoustical stress and strain bending of the boards can change the electrical properties of the integrated circuits which can in turn alter the behavior properties of the device. For an RF component such as a Voltage Control Oscillator (VCO), the mechanical bending can vary the voltage, and, the VCO frequency deviates in relation to the bending. The deviation effectively superimposes properties of the acoustic signal onto the demodulated signal. In effect, the physical bending can modulate the behavior of the demodulator where the result can be regeneration of the output audio on top of the demodulated signal. This behavior is a feedback loop which can oscillate and go unstable when the signals become highly correlated, or in phase. In effect, the regenerative audio feedback acts as a parasitic modulation that gets demodulated and amplified over and over causing oscillatory feedback, commonly called 'microphonics'. The internal pressure is inversely proportional to the internal air volume. And, as handsets become smaller the microphonics problem can continue to increase. Accordingly, a smaller handset can go unstable at high volumes which causes a howling effect as a result of receiver audio regeneration.

Solutions to avoid the bending of the circuit boards include material padding to absorb the sound, mechanical ribs or clips to limit the allowable degree of mechanical bending, and non-piezoelectric capacitors. The current approaches attempt to minimize the acoustic pressure build-up and/or isolate the acoustic coupling. They rely on mechanical solutions that can not fully resolve the howling problem caused by the regenerative audio feedback. In addition, system engineers set a specification margin for certain parameters in shipping radios to account for tolerances in parts and variances in temperature. However, this lowers the overall volume gain of the handset. A final recourse, when the mechanical solutions are insufficiently capable of mitigating the howling behavior, is to lower the level of high audio speaker output by setting a maximum volume level corresponding to a gain specification level below which howling occurs. Accordingly, the handset is shipped with a reduced loudness gain to meet the gain specification margin. However, this reduces the overall loudness level which users expect from a high audio speaker handset. In a public safety environment, or other high ambient noise condition, such restriction may not be acceptable.

SUMMARY OF THE INVENTION

The present embodiments herein concern a method and system for suppressing receiver audio regeneration. The method includes the steps of receiving a communication signal, at a Radio Frequency (RF) unit, demodulating the communication signal to an audio signal, monitoring a volume level of the audio signal, and shifting the pitch of the audio signal when the volume level reaches a predetermined threshold. The amount of pitch-shifting can be a function of the volume level. Playing the pitch-shifted audio signal out of a speaker produces a pitch-shifted acoustic signal. The method can shift the pitch of the audio signal to produce the pitch-shifted acoustic signal with signal properties suppressing regeneration of the acoustic signal onto the audio signal at the RF unit.

As an example, the audio signal can be an analog or digitally sampled signal. In one arrangement, the step of monitoring the volume level includes estimating an acoustic signal volume for at least a portion of the time-based samples of the audio signal, and based on the estimating step, generating a volume contour of the acoustic signal. In another arrangement, the pitch of the audio signal can be shifted when the volume contour exceeds a predetermined volume level threshold, where the amount of pitch-shifting can be a function of the volume level of the acoustic signal. Additionally, shifting the pitch can be done by one of increasing and decreasing the pitch of the audio signal, and the amount of pitch shifting can be within a predetermined range.

The method can also include the steps of detecting speech activity on the audio signal, and, when detecting speech on the audio signal, determining whether the volume contour exceeds a predetermined threshold. For example, if no speech is detected on the audio signal, the method can include predicting the amount of pitch shifting. Accordingly, the level of pitch shifting applied can remain constant during a pause in the speech. Accordingly, the pitch-shifting of the audio signal can suppress the RF unit from entering unstable oscillation. For example, the pitch shifting can reduce the correlation between the high level audio acoustic output and the demodulated audio signal and suppress the handset from entering feedback and howling. The method can also include the steps of evaluating a gain margin and/or phase margin; and updating the predetermined threshold level based on the gain margin and/or phase margin. In one arrangement, the predetermined threshold sets an allowable gain headroom. For example, the gain margin and/or phase margin can describe the allowable extent of pitch shifting before unstable oscillation.

The embodiments of the present invention also concern a method and system for suppressing receiver audio regeneration. The system includes a RF unit to receive a communication signal, where the RF unit contains a demodulator that demodulates the communication signal to an audio signal having a volume level; a pitch-shifter coupled to the demodulator, wherein the pitch-shifter shifts the pitch of the audio signal when the volume level reaches a predetermined threshold, where the amount of pitch-shifting is a function of the volume level; and a speaker connected to the pitch shifter, wherein the speaker plays the pitch-shifted audio signal to produce a pitch-shifted acoustic signal. For example, the pitch-shifter shifts the pitch of the audio signal by an amount that suppresses regeneration of an acoustic signal onto the audio signal at the RF unit.

The pitch shifter can additionally include an analysis section that monitors a volume level of the audio signal, and when the volume level exceeds a predetermined volume level threshold, the pitch-shifter shifts the pitch of the audio signal by an amount that is a function of the volume level of the acoustic signal. In one arrangement, the pitch-shifter shifts the pitch of the audio signal by one of increasing and decreasing the pitch of the audio signal by an amount within a predetermined range. The system can also include an analysis section which can include a volume estimator block that estimates the acoustic signal volume for at least a portion of the time-based samples of the audio signal; and an envelope module that generates a volume contour of the acoustic signal based on the volume estimation. In one arrangement, the analysis section can further include a speech detector that can detect speech activity on the audio signal, and a threshold unit cooperatively connected to the speech detector that determines when the volume contour exceeds the predetermined threshold. For example, the speech detector can detect speech on the audio signal and the pitch-shifter can shift the pitch of the audio signal to suppress unstable oscillation in the RF unit.

In another arrangement, the pitch-shifter can include a stability unit that evaluates one of a gain margin and phase margin, and, based on the margin, the stability unit updates a predetermined threshold level to an allowable extent of pitch shifting before unstable oscillation. The system can also include suitable software and/or circuitry to carry out the processes described above.

The embodiments of the present invention also concern a machine readable storage medium, having stored thereon a computer program having a plurality of code sections executable by a portable computing device. The code sections cause the portable computing device to perform the steps of at a RF unit receiving a communication signal, demodulating the communication signal into an audio signal, monitoring a volume level of the audio signal, shifting the pitch of the audio signal when the volume level reaches a predetermined threshold, wherein the amount of pitch-shifting is a function of the volume level, and playing the pitch-shifted audio signal out of a speaker to produce a pitch-shifted acoustic signal. At the RF unit, the code sections pitch-shift the audio signal to produce a pitch-shifted acoustic signal with signal properties suppressing regeneration of the acoustic signal onto the audio signal at the RF unit.

BRIEF DESCRIPTION OF THE DRAWINGS

The features of the embodiments which are believed to be novel, are set forth with particularity in the appended claims. The embodiments may best be understood by reference to the following description, taken in conjunction with the accompanying drawings, in the several figures of which like reference numerals identify like elements, and in which:

DETAILED DESCRIPTION

Figure 1:
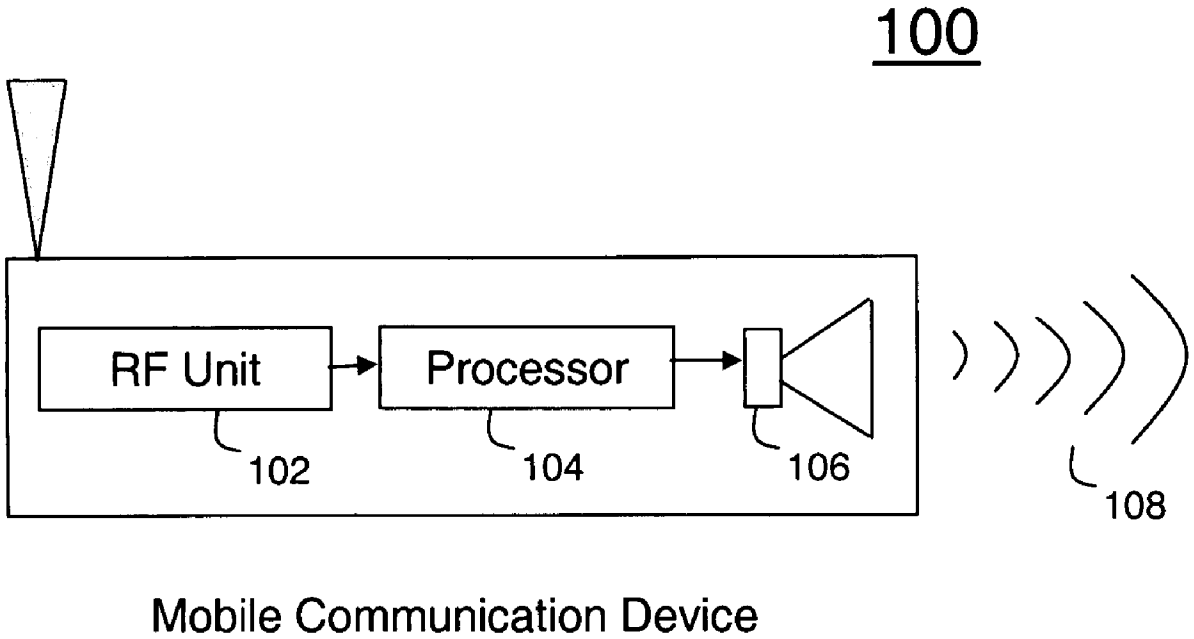
FIG. 1 illustrates a mobile communication device in accordance with an embodiment of the inventive arrangements.

While the specification concludes with claims defining the features of the embodiments in accordance with the invention that are regarded as novel, it is believed that the embodiments will be better understood from a consideration of the following description in conjunction with the drawing figures, in which like reference numerals are carried forward.

As required, detailed embodiments are disclosed herein; however, it is to be understood that the disclosed embodiments can be embodied in various forms. Therefore, specific structural and functional details disclosed herein are not to be interpreted as limiting, but merely as a basis for the claims and as a representative basis for teaching one skilled in the art to variously employ the embodiments in virtually any appropriately detailed structure. Further, the terms and phrases used herein are not intended to be limiting but rather to provide an understandable description of the invention.

The terms a or an, as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically. The terms program, software application, and the like as used herein, are defined as a sequence of instructions designed for execution on a computer system. A program, computer program, or software application may include a subroutine, a function, a procedure, an object method, an object implementation, an executable application, an applet, a servlet, a source code, an object code, a shared library/dynamic load library and/or other sequence of instructions designed for execution on a computer system.

The embodiments herein present a method and system for suppressing receiver audio regeneration. For example, a communication system can transmit a communication signal to a receiving mobile communication device. The mobile device can demodulate the communication signal to an audio signal and monitor a volume level of the audio signal as it is played out a high audio speaker. The mobile device can shift the pitch of the audio signal as a function of the volume level when the volume level reaches a predetermined threshold. The device can play the pitch-shifted audio signal out of a speaker to produce a pitch-shifted acoustic signal with signal properties suppressing regeneration of the acoustic signal onto the audio signal at the RF unit, thereby suppressing feedback and microphonic howling.

Referring to FIG. 1 a mobile communication device 100 is shown. The mobile communication device 100 can include a Radio Frequency (RF) unit 102, a processor 104, and a speaker 106. In one arrangement, the RF unit can receive a communication signal, containing data such as voice or audio, from another such mobile communication device. The mobile communication device 100 can be a two-way radio, a cellular phone, a handset, a personal digital assistant, a portable computing device, or other similar devices. The mobile communication device 100 can also transmit communication signals.

In one arrangement, the RF unit 102 can be cooperatively connected to the processor 104 which can be coupled to the speaker 106. The RF unit 102 can pass a demodulated base-band signal, such as voice or audio, to the processor 104. The processor 104 can apply various signal processing techniques to put the signal in proper form to be played out a speaker, such techniques include echo suppression, noise suppression, compression, automatic gain adjustment, and volume control for example. The speaker 106 can output the audio signal at a high signal level to produce an acoustic signal which can be heard by a user of the mobile communication device 100.

Figure 2:
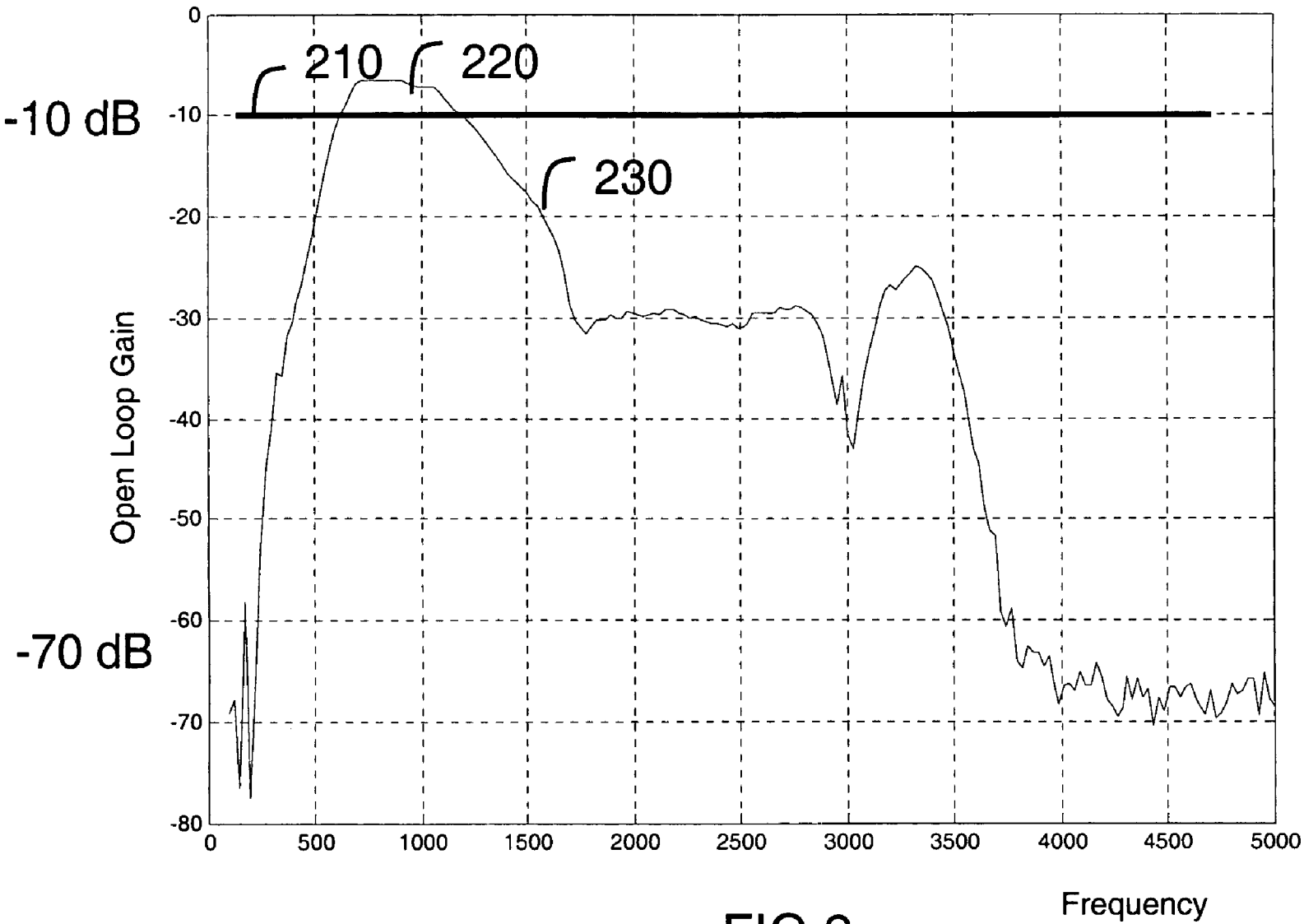
FIG. 2 illustrates a handset volume graph in accordance with an embodiment of the inventive arrangements.

Referring to FIG. 2, a graph characteristic of the open-loop gain (OLG) for a mobile communication device 100 is shown. The OLG graph describes the resulting volume level of the device as measured across the audible frequency spectrum during open loop gain measurement. The open-loop gain of an amplifier can be described as the gain obtained when no feedback is used in the circuit. Open-loop gain is generally high for an operational amplifier and can rapidly decrease with increasing frequency. For example, OLG levels can describe the point at which Microphonic feedback begins. Referring to FIG. 1, for example, the acoustic output 108 can be of sufficient volume level to cause the mobile device to enter microphonic feedback and cause howling. The howling can be a function of excessive gain in the feedback loop. As another example of microphonic behavior, it is known in the art that when the output of a speaker is fed back into the same microphone producing the speaker output, the system will encounter feedback due to the perpetual amplification of the signal as it amplifies back on itself. Similarly, the speaker acoustic output 108 can cause the mobile communication device 100 to enter feedback when an open loop gain given on the y-axis reaches a level causing unstable oscillation. The open loop gain can reveal the volume level at which the system will enter oscillation.

System designers use the graph of FIG. 2 to determine the maximum volume level they can allow within the mobile communication device 100 before reaching instability, i.e. howling. For example, at 210, an OLG specification margin of−10 dB can be imposed to ensure that the handset has 10 dB of headroom gain before instability. Headroom gain can be compromised for loudness, thereby making the volume louder without going unstable but at a cost of more distortion. They can expect users to tolerate a certain amount of distortion to preserve volume loudness. Accordingly, the maximum volume level can be reduced to achieve the gain OLG spec margin by sacrificing overall maximum loudness. FIG. 2. also reveals that the gain margin is frequency dependent. For example, at 220, the OLG spec gain is representative of an approximate frequency range between 700 Hz and 1.3 KHz. For example, a voice signal can have an average bandwidth between 200 Hz to 4 KHz which falls within this OLG bandwidth. Hence, a voice signal played out the speaker at sufficiently high volume levels within this bandwidth can cause the mobile communication device 100 to go unstable, and enter oscillation. The receiver audio's self regeneration (i.e. unstable feedback) can occur in a limited frequency band as seen at 220 within the 300-kHz pass band.

Figure 3:
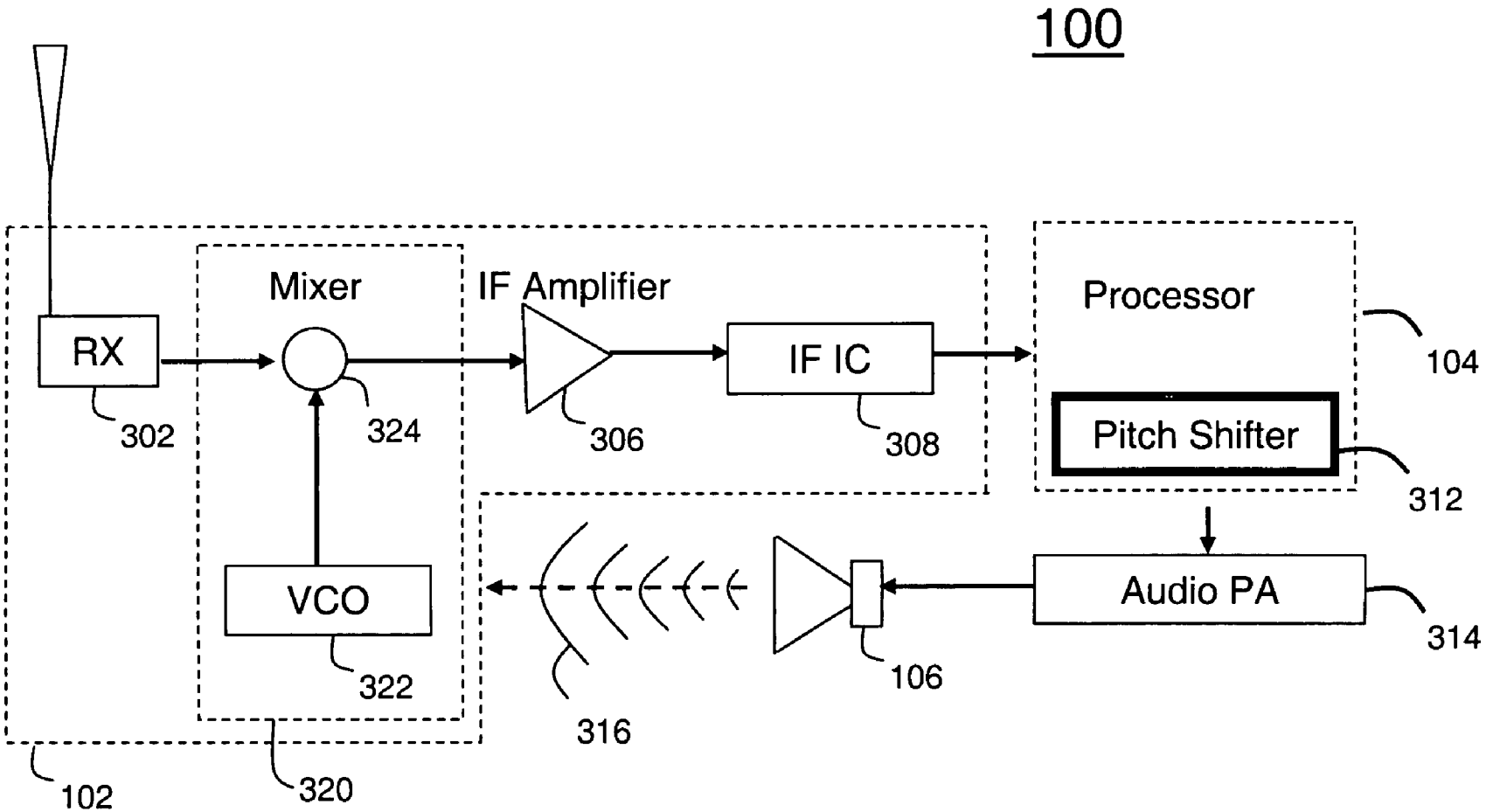
FIG. 3 illustrates a block diagram of a receiver system in accordance with an embodiment of the inventive arrangements.

Referring to FIG. 3 a more detailed block diagram of the mobile communication device 100 is shown. In one arrangement, the RF unit 102 can contain a receiver (RX) 302 that can receive a communication signal and a demodulator 320 that demodulates the received communication signal. In one arrangement, the demodulator 320 can include a mixer 324 and a Voltage Controlled Oscillator (VCO) 322 that together can demodulate the communication signal.

The RF unit 102 can also include an Intermediate Frequency (IF) amplifier 306 and IF integrated circuit 308. The IF amplifier 306 can increase the signal fidelity (signal to noise ratio) to improve the demodulation at the secondary IF IC 308. As is known in the art, an IF stage 306-308 can utilize high quality crystals and circuits to demodulate a high frequency signal down to base-band. It should also be noted that the particular embodiment of the IF section 306-308 can be included or excluded without affecting the scope of the claimed embodiments of the invention. Accordingly, the demodulator 320 can demodulate the communication signal directly to an audio signal without going through an IF stage 306-308.

In one arrangement, the processor 104 can include a pitch shifter 312 that can pitch shift an audio signal. The processor 104 can be cooperatively connected to an audio power amplifier (PA) 314 which can be cooperatively connected to a speaker 106. The pitch shifter can reside inside or outside the processor 104 as an independent module. Briefly, the processor can receive an audio signal from the RF unit 102 and place the audio signal in form such that the power amplifier 314 can play the audio signal out the speaker 106. The pitch shifter 312 can shift the pitch of the audio signal prior to being amplified by the audio PA 314. Notably, the high audio acoustic signal 316 generated by the speaker 106 can feedback into the RF unit 102 internally through the housing or externally through the air.

Figure 4:
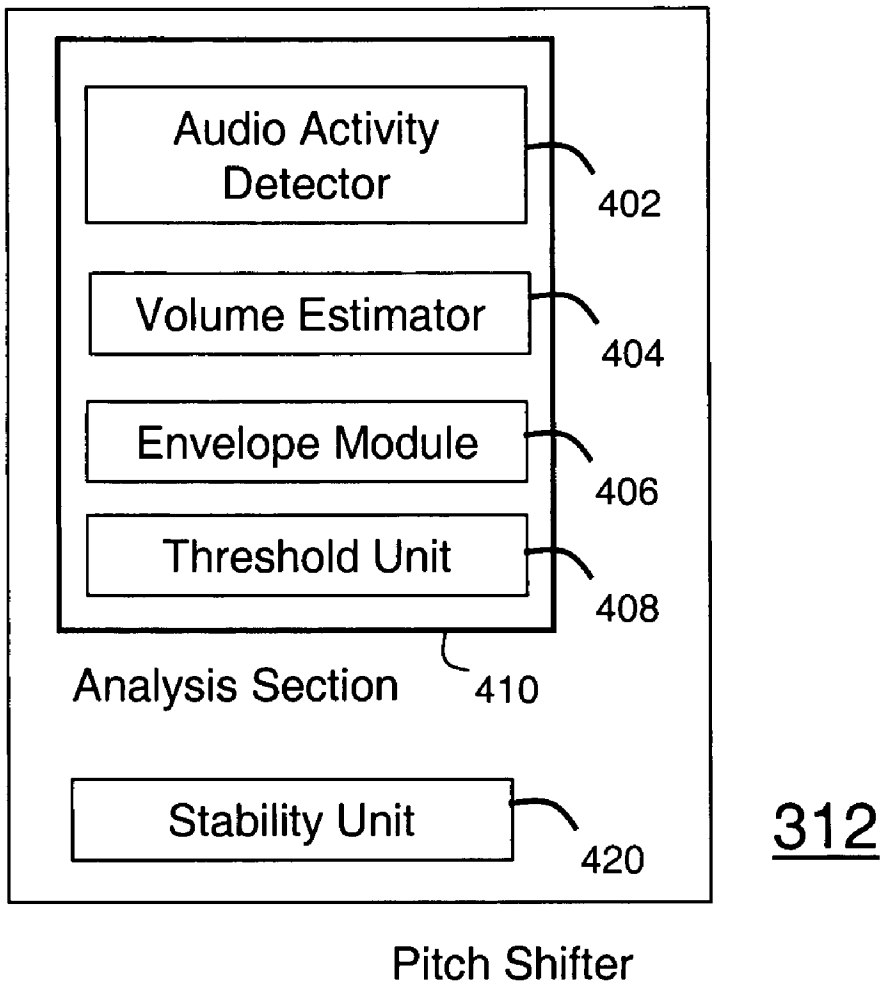
FIG. 4 illustrates components within a pitch-shifter in accordance with an embodiment of the inventive arrangements.

Referring to FIG. 4, a more detailed block diagram of the pitch shifting unit 312 is shown. In one arrangement, the pitch shifting unit 312 includes an analysis section 410 and a stability unit 420. Briefly, the analysis section 410 monitors a volume level of the audio signal, and when the volume level exceeds a predetermined volume level threshold, the pitch-shifter 312 shifts the pitch of the audio signal by an amount that can be a function of the volume level of the acoustic signal.

In one arrangement, the analysis section can include an audio activity detector 402 for detecting activity of the audio signal, a volume estimator block 404 to estimate the acoustic signal volume 316 during audio activity for at least a portion of the time-based samples of the audio signal, an envelope module 406 cooperatively connected to the estimator block 404 to generate a volume contour of the acoustic signal based on the volume estimation, and a threshold unit 408 to determine when the volume contour exceeds the predetermined threshold when the speech detector detects speech on the audio signal.

The stability unit 420 can evaluate at least one of a gain margin and phase margin, and, based on at least one of the gain margin and phase margin, update the predetermined threshold to set an allowable gain headroom. For example, the margin margin can reveal an allowable extent of pitch shifting before the mobile communication device 100 enters unstable oscillation.

Figure 5:
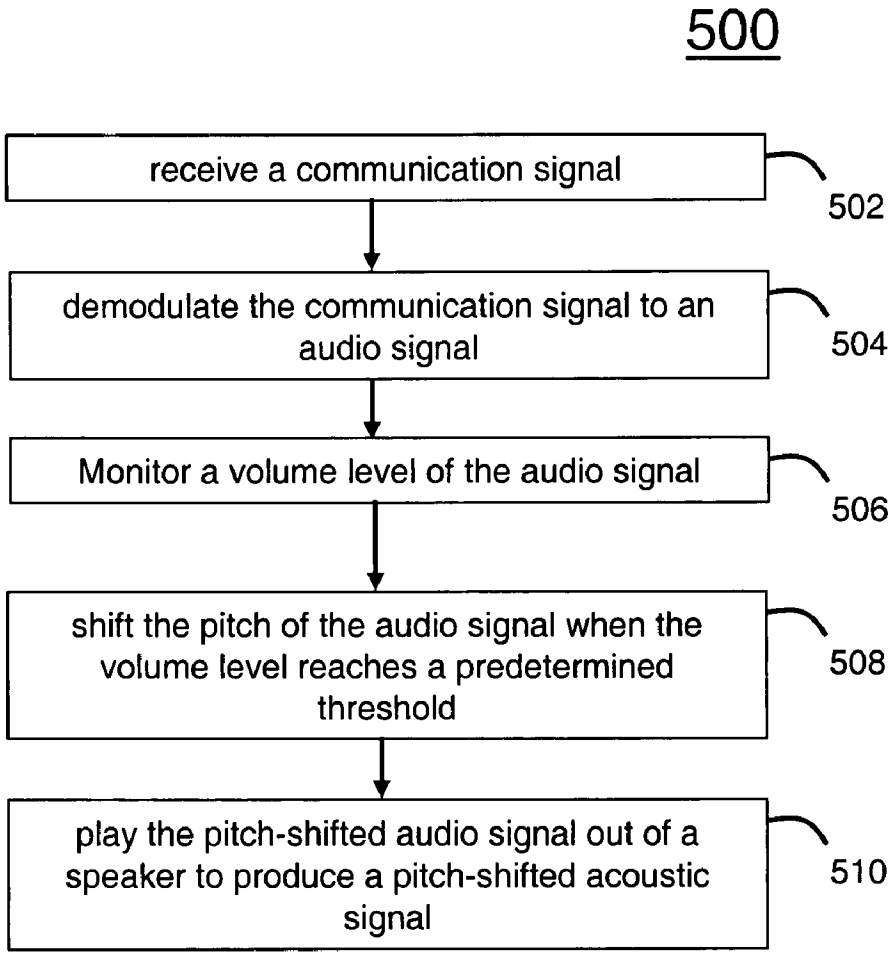
FIG. 5 illustrates a method of pitch shifting in accordance with an embodiment of the inventive arrangements.

Referring to FIG. 5, a method for suppressing receiver audio regeneration is shown. When describing the method 500, reference will be made to FIGS. 3 and 4, although it must be noted that the method can be practiced in any other suitable system or device. Further note that the method 500 is not limited to the order in which the steps are listed. In addition, the method 500 can contain a greater or a fewer number of steps than those shown in FIG. 5.

At step 502, a communication signal is received. At step 504, the communication signal is demodulated to an audio signal. For example, referring to FIG. 3., the RX unit 302 receives a communication signal. The RF unit 320, which includes the mixer 324 and VCO 322, demodulates the communication signal to a base-band signal. The IF Amplifier 306 and IF IC 308 can further demodulate the base-band signal to an audio signal. Alternatively, the RF unit can demodulate the communication signal directly down to an audio signal.

At step 506, the volume level of the audio signal is monitored. At step 508, the pitch of the audio signal is shifted when the volume level reaches a predetermined threshold, where the amount of pitch-shifting is a function of the volume level. For example, referring to FIG. 3, the Processor 104 determines when a volume level of the audio signal exceeds a threshold. The processor 104 can include a pitch-shifter 312 which shifts the pitch of the audio signal when the processor determines the volume level has been exceeded. Additionally, the step of monitoring the volume level can further include detecting speech activity on the audio signal, and when detecting speech on the audio signal, determining whether the volume contour exceeds the predetermined threshold. For example, referring to FIG. 4, the audio activity detector 402 detects voice and audio activity on the audio signal. The volume estimator 404 estimates the audio level volume and the envelope module 406 estimates a volume contour. And, the threshold unit 408 determines when a volume threshold has been exceeded.

At step 510, the pitch-shifted audio signal is played out of a speaker to produce a pitch-shifted acoustic signal. For example, referring to FIG. 3, the audio PA 314 amplifies the pitch shifted signal and plays it out the speaker 314. The method 500 additionally includes evaluating at least one of a gain margin and phase margin, and updating a predetermined threshold level based on the margin, where the updating sets an allowable gain headroom, and the margin reveals an allowable extent of pitch shifting before unstable oscillation. For example, referring to FIGS. 3 and 4, the stability unit 420 determines the amount of gain and phase margin of the RF unit 102.

Figure 6:
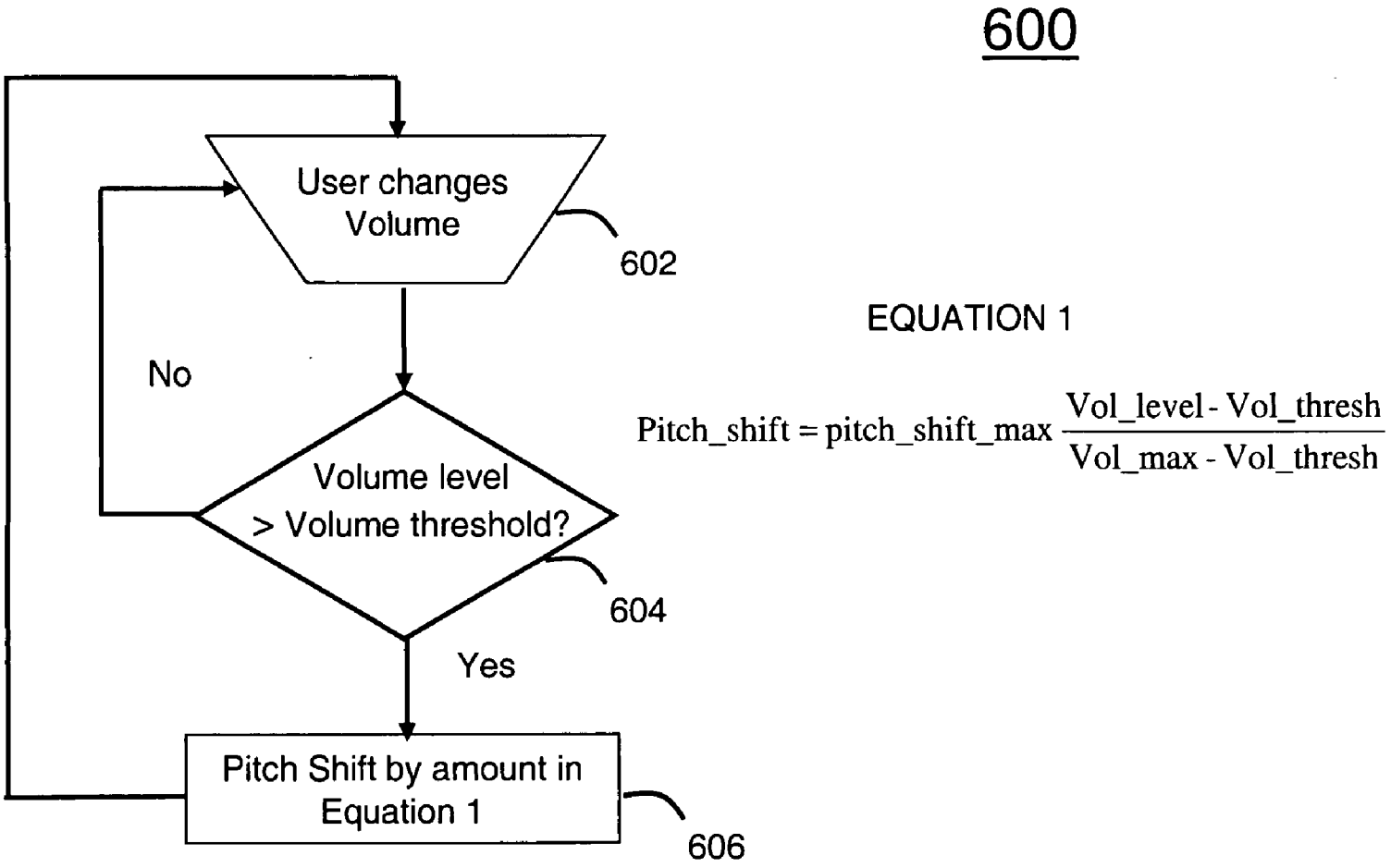
FIG. 6 illustrates a flowchart method of pitch shifting in accordance with an embodiment of the inventive arrangements.

Referring to FIG. 6, a flowchart method for suppressing receiver audio regeneration is shown which can inherently include the steps of method 500. When describing the method 600, reference will also be made to FIGS. 3 and 4, although it must be noted that the method can be practiced in any other suitable system or device. Moreover, the method is not limited to the order in which the steps are listed in the method 600. In addition, the method 600 can contain a greater or a fewer number of steps than those shown in FIG. 6.

At step 602, a user changes the volume level of the mobile communication device 100, hereto referred to as the handset 100. For instance, the user can turn a volume control knob or depress a volume button on the handset to increase or decrease the volume level. Referring to FIG. 3, the volume level can be the SPL level of the acoustic signal 316 measured at the speaker 106 or an SPL level associated with the volume step. For example, volume step 1 on the handset can have a 1 kHz reference volume level SPL of 76 dB, and a 1 kHz reference volume level SPL of 104 dB at volume step 7. The SPL at kHz can be one point of an SPL curve across frequency. Those skilled in the art can appreciate that there can be a SPL curve across frequency at varying levels for each volume step. Referring to FIG. 3, a volume step increase can increase the acoustic signal level 316, and accordingly increase the vibration of the RF unit 102. The increased vibration can lead to howling if the volume level is higher than a predetermined amount, i.e. the "volume threshold". For example, referring to FIG. 2, a volume threshold of 94 dB can be associated with the OLG spec margin of–10 dB SPL at location 210. Accordingly, a volume level measured at 104 dB can exceed the 94 dB volume threshold which can cause the handset 100 to howl.

Referring to FIGS. 3 and 4, the audio activity detector 402, identifies periods of active audio or voice, and uses various approaches to determine audio activity such as energy level, periodicity, and spectral shape for example. When the activity detector 402 determines audio activity, the volume estimator 404 estimates the volume level SPL of the acoustic signal 316 output by the speaker 106. For example, the volume estimator 404 measures the SPL of the acoustic output signal 316 using a microphone to capture the output acoustic signal. This would be a closed loop configuration. Alternatively, an open loop configuration can be employed for which the volume estimator 404 measures the volume level by mapping volume step settings on the handset to SPL values. This mapping function is different from the mapping function of FIG. 6.

For example, volume step 7 can correspond to an overall volume level but have an associated set of SPL values on a curve across frequency, i.e. frequency spectrum. And, the volume estimator 404 can calculate the volume level from the SPL curve in the frequency domain. For example, the volume level can be a frequency weighted summation of the SPL points along the SPL curve. Accordingly, the envelope module 406 generates a simpler time-based volume contour of the acoustic signal 316 from volume level measurements by the volume estimator 404 across time. As an example, a simple first order moving average filter is used to generate the time-based volume contour from measured volume levels. It should be noted that the SPL curve is representative of a portion of an audio segment at a particular moment in time, such as a frequency spectrum. The SPL curve can be a discrete or continuous set of points across frequency to the particular time segment. Whereas, the volume contour is the overall SPL volume level encompassing all frequencies at each point, and where the contour denotes a representation of the individual volume levels across time.

Referring back to FIG. 6, at decision block 604, the volume level is compared against a volume threshold. If the volume level is greater than the volume threshold the audio signal is shifted in pitch by an amount specified in Equation 1 within FIG. 6 (Vol_is short for Volume).

$$\text{Pitch_shift} = \text{pitch_shift_max}\frac{\text{Vol_level} - \text{Vol_threshold}}{\text{Vol_max} - \text{Vol_threshold}} \qquad \text{Equation 1}$$

For example, referring to FIGS. 3 and 4, the threshold unit 408 determines when the volume contour exceeds the predetermined threshold. If it does, the pitch shifter 312 shifts the pitch of the audio signal by an amount that is a function of the volume level of the acoustic signal. Recall from FIG. 3, that the VCO's 322 fundamental frequency can unintentionally vary causing howling due to mechanical vibrations of the board as a result of high audio acoustic pressure from the acoustic signal 316 produced by the speaker 106.

At decision block 606, the audio signal is pitch shifted by an amount to suppress regeneration of the acoustic signal onto the audio signal, and where the amount of pitch-shifting is a function of the volume level.

Briefly, referring to FIG. 3, the pitch-shifter 312 shifts the pitch of the audio signal to suppress unstable oscillation in the RF unit 102. The pitch shifter 312 changes the pitch of high volume level acoustic signals to suppress phase reinforcement and the associated howling characteristic of oscillatory behavior.

Figure 7:
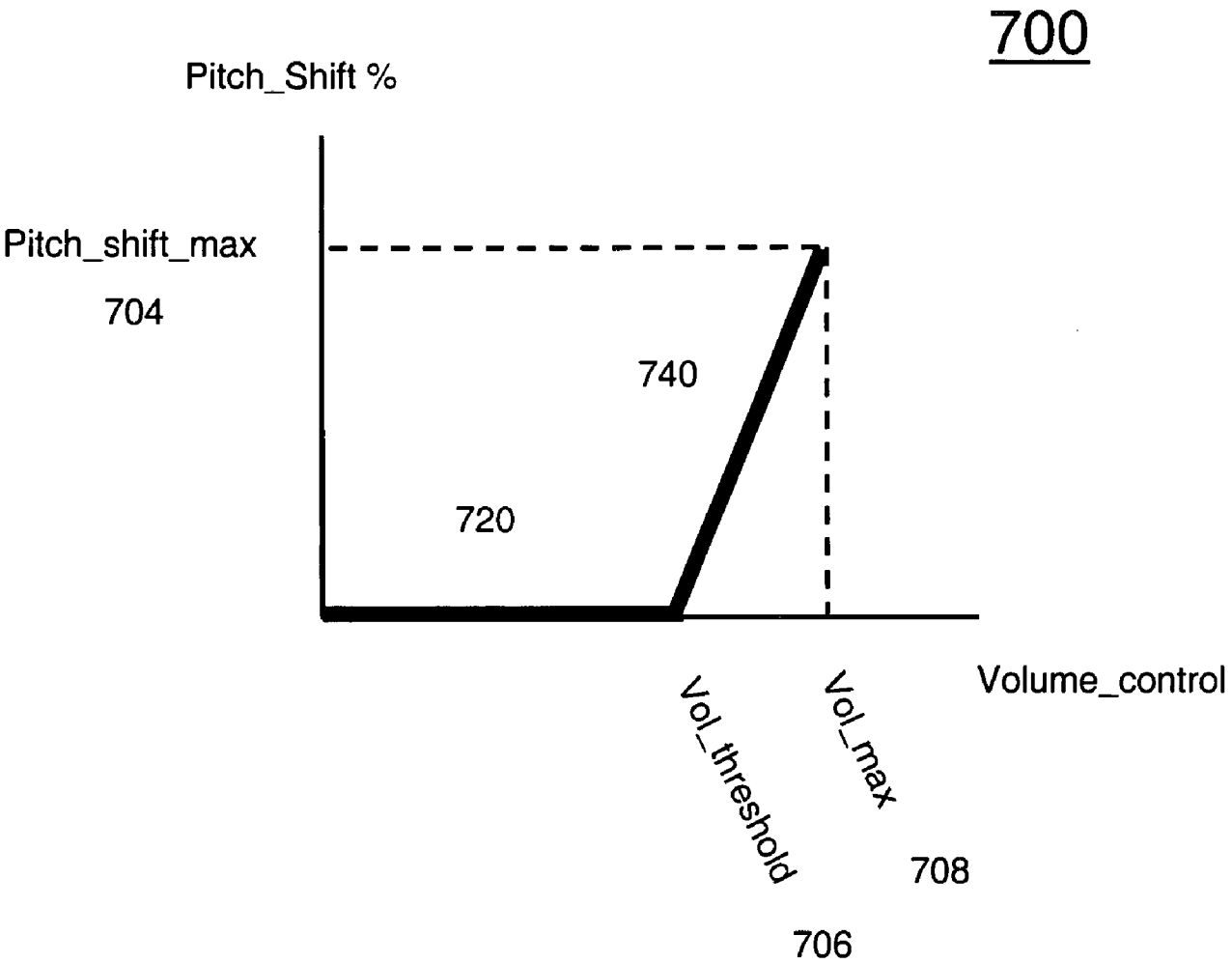
FIG. 7 illustrates a graph for pitch shifting as a function of volume level in accordance with an embodiment of the inventive arrangements.

The amount of pitch shift applied can be a linear function of the audio level. For example, referring to FIG. 7, the x-axis presents the measured volume level provided by the volume estimator 404. The y-axis presents the amount of pitch shifting that can be applied as a function of the measured volume level. The piecewise linear function represents the relationship between volume level and pitch shifting. For example, until the measured volume level exceeds a volume threshold 706, there is no pitch shifting applied to the audio signal, as seen along the straight line 720. Once the measured volume exceeds the volume threshold 706, the audio signal can be shifted in pitch in accordance with the values of the straight line 740. For example, the pitch shifter 312 can evaluate Equation 1 to calculate the required amount of pitch shifting to be applied to the audio signal. For instance, Equation 1 is the slope (dy/dx) of the line at 740 weighted by a pitch_shift_max term, where the slope of the line 740 reveals the linear extent of pitch shifting. One skilled in the art can appreciate that any line or curve can be drawn to represent the amount of pitch shifting as a function of the volume level. Accordingly, the pitch shifter 312 can use any suitable compression algorithm where one particular example of a compression curve is the piece-wise linear relationship shown in FIG. 7.

For example, the sloped line at 740 represents a linear mapping function from a range of volumes (vol_threshold to vol_max) to an extent of pitch shifting. For example, referring to FIG. 4, when the threshold unit 408 determines that the volume level equals the volume_max at 708, the pitch shifter 312 can apply the pitch_shift_max amount. For instance, the system designer can set pitch_shift_max at 20%, which allows the pitch shifter 312 to apply a 20% pitch shifting of the audio signal when maximum volume is detected. As another example, the audio signal can be pitch shifted upwards by 10% to correspond to a maximum volume level or it can be shifted down by 10% to correspond to the maximum volume level. Accordingly, the max pitch_shift_max, or mapping function 704, can be any level or set of levels that the system designer determines suppresses or limits unstable oscillation. One skilled in the art can recognize that the system designer can create any linear or non-linear mapping function relating the volume level to a percentage (amount) of pitch shifting.

Briefly, the pitch shifter 312 causes the audio to return at slightly different frequencies each time it passes through the microphonics loop. Eventually the regenerative audio feedback will fall out of the microphonics band and no phase alignment will occur. For instance, the pitch shifter 312 shifts a portion of the audio spectrum away from its original location to avoid creating a resonance condition. For example, referring to FIGS. 2 and 3 the pitch shifter 312 shifts a band of voice energy out of a higher OLG gain region 220 to a lower OLG region 230 where the handset 100 is below specification margin and less sensitive to regenerative audio feedback howling.

Those skilled in the art can appreciate that the pitch shifter 312 can implement a time domain or frequency domain approach to shift the pitch of the audio signal. Briefly, a pitch shifter changes the fundamental frequency of audio or voice without changing the time representation. Various methods of pitch shifting are possible including changing the sampling rate. More sophisticated methods such as time or frequency decomposition methods allow for non-integer sampling rate changes which provide a smoother pitch interpolation between speech frame boundaries and doing so without adjusting the time scale.

While the preferred embodiments of the invention have been illustrated and described, it will be clear that the invention is not so limited. Numerous modifications, changes, variations, substitutions and equivalents will occur to those skilled in the art without departing from the spirit and scope of the appended claims.

What is claimed is:

1. A method for suppressing receiver audio regeneration, comprising the steps of:

receiving a communication signal;

at a Radio Frequency (RF) unit, demodulating the communication signal to an audio signal;

monitoring a volume level of the audio signal;

shifting a pitch of the audio signal when the volume level reaches a predetermined threshold to produce a pitch shifted audio signal, wherein an amount of pitch-shifting of the audio signal is a function of the volume level; and playing the pitch-shifted audio signal out of a speaker to produce a pitch-shifted acoustic signal;

wherein the amount of pitch-shifting applied to the audio signal produces a pitch-shifted acoustic signal with signal properties suppressing regeneration of the acoustic signal onto the audio signal at the RF unit.

2. The method according to claim 1, wherein the step of monitoring the volume level comprises the steps of:

estimating an acoustic signal volume for at least a portion of the time-based samples of the audio signal; and based on the estimating step, generating a volume contour of the acoustic signal.

3. The method according to claim 2, wherein the pitch of the audio signal is shifted when the volume contour exceeds the predetermined threshold, wherein the amount of pitch-shifting of the audio signal is a function of the volume level of the acoustic signal.

4. The method according to claim 2, wherein the step of monitoring the volume level further comprises the steps of:

detecting speech activity on the audio signal; and when detecting speech on the audio signal, determining whether the volume contour exceeds the predetermined threshold.

5. The method according to claim 4, wherein if no speech is detected on the audio signal, the method further comprises predicting the amount of pitch shift.

6. The method according to claim 1, wherein shifting the pitch can be done by one of increasing and decreasing the pitch of the audio signal, wherein the step of shifting the pitch can be on one of a linear and non-linear scale.

7. The method according to claim 1, wherein the amount of pitch shifting is within 20% of the audio signal.

8. The method according to claim 1, wherein the pitch-shifting of the audio signal suppresses the RF unit from entering unstable oscillation.

9. The method according to claim 1, further comprising the steps of:

evaluating a margin; and updating the predetermined threshold level based on the margin, wherein the updating sets an allowable gain headroom;

wherein the margin can be one of a gain margin and phase margin that reveals an allowable extent of pitch shifting before unstable oscillation.

10. The method according to claim 1, wherein the demodulating the communication signal further comprises demodulating to an intermediate frequency signal, followed by demodulating the intermediate frequency signal to the audio signal.

11. A system for suppressing receiver audio regeneration, comprising:

a Radio Frequency (RF) unit to receive a communication signal, containing a demodulator, wherein the demodulator demodulates the communication signal to an audio signal having a volume level;

a pitch-shifter coupled to the demodulator, wherein the pitch-shifter shifts a pitch of the audio signal when the volume level reaches a predetermined threshold to produce a pitch-shifted audio signal, wherein the amount of pitch-shifting shifting is a function of the volume level; and a speaker connected to the pitch shifter, wherein the speaker plays the pitch-shifted audio signal to produce a pitch-shifted acoustic signal;

wherein the pitch-shifter shifts the pitch of the audio signal by an amount that suppresses regeneration of an acoustic signal onto the audio signal at the RF unit.

12. The system according to claim 11, wherein the pitch shifter further comprises an analysis section that monitors a volume level of the audio signal, and when the volume level exceeds the predetermined threshold, the pitch-shifter shifts the pitch of the audio signal by an amount that is a function of the volume level of the acoustic signal.

13. The system according to claim 12, wherein the audio signal is comprised of a plurality of time-based samples and wherein the analysis section comprises:

a volume estimator block to estimate the acoustic signal volume for at least a portion of the time-based samples of the audio signal; and an envelope module cooperatively connected to the volume estimator to generate a volume contour of the acoustic signal based on the volume estimation.

14. The system according to claim 12, wherein the analysis section further comprises:

a speech detector for detecting speech activity on the audio signal; and a threshold unit cooperatively connected to the speech detector to determine when the volume contour exceeds the predetermined threshold, when the speech detector detects speech on the audio signal.

15. The system according to claim 11, wherein the pitch-shifter shifts the pitch of the audio signal by one of increasing and decreasing the pitch of the audio signal.

16. The system according to claim 11, wherein the pitch-shifter shifts the pitch of the audio signal up to 20%.

17. The system according to claim 11, wherein the pitch-shifter shifts the pitch of the audio signal to suppress unstable oscillation in the RF unit.

18. The system according to claim 11, wherein the pitch-shifter further comprises a stability unit to evaluate a margin, and, based on the margin, wherein the margin can be one of a gain margin and phase margin which reveals an allowable extent of pitch shifting before unstable oscillation, update the predetermined threshold to set an allowable gain headroom.

19. A machine readable storage medium, having stored thereon a computer program having a plurality of code sections executable by a portable computing device for causing the portable computing device to perform the steps of:

at a Radio Frequency (RF) unit, receiving a communication signal;

demodulating the communication signal into an audio signal;

monitoring a volume level of the audio signal;

shifting the pitch of the audio signal when the volume level reaches a predetermined threshold, wherein the amount of pitch-shifting is a function of the volume level; and playing the pitch-shifted audio signal out of a speaker to produce a pitch-shifted acoustic signal;

wherein the pitch-shifting produces a pitch-shifted acoustic signal with signal properties suppressing regeneration of the acoustic signal onto the audio signal at the RF unit.

20. A system for suppressing receiver audio regeneration, comprising the steps of:

generating a volume contour for an acoustic signal;

monitoring the volume level of the volume contour; and shifting the pitch of an audio signal when the volume level reaches a predetermined threshold;

wherein the pitch-shifter shifts the pitch of the audio signal to produce a pitch-shifted acoustic signal with signal properties suppressing regeneration of the acoustic signal onto the audio signal at a RF unit.

* * * * *